US005129848A

United States Patent [19]

Etheridge et al.

[11] Patent Number: 5,129,848

[45] Date of Patent: Jul. 14, 1992

[54] CONTROLLABLE VARIABLE DEPTH MOORING SYSTEM AND METHOD

[75] Inventors: Charles O. Etheridge; Peter F. Poranski, Sr., both of Houston, Tex.

[73] Assignee: Sofec, Inc., Houston, Tex.

[21] Appl. No.: 718,628

[22] Filed: Jun. 21, 1991

[51] Int. Cl.[5] ..... B63B 21/00

[52] U.S. Cl. ..... 441/2; 441/29

[58] Field of Search ..... 441/1, 3, 4, 5, 21, 441/22, 23, 24, 25, 26, 32, 33, 2, 29, 28; 114/230

[56] References Cited

U.S. PATENT DOCUMENTS

| | | | |
|---|---|---|---|
| 3,465,374 | 9/1969 | Johnson et al. | 441/29 |
| 3,487,486 | 1/1970 | Leonard et al. | 441/29 |
| 3,576,171 | 4/1971 | D'Angelo | 441/23 |
| 3,677,539 | 7/1972 | Bennet | 441/23 |
| 3,742,535 | 7/1973 | Horrer et al. | 441/23 |

*Primary Examiner*—Jesus D. Sotelo
*Assistant Examiner*—Stephen P. Avila
*Attorney, Agent, or Firm*—Dodge, Bush, Moseley & Riddle

[57] ABSTRACT

A mooring system and method of anchoring a buoyant module (16) in a submerged location in the sea for supporting an underwater structure such as a plurality of acoustical arrays (18) for receiving and transmitting acoustical signals is disclosed. The buoyant module (16) is held in a submerged position by at least one anchor leg or line (46) anchored to the sea floor and of a variable length to permit controlled movement of the module (16) to the sea surface (10) for servicing. The single anchor line (46) is a stretchable line and includes an upper segment (56) formed of a Kevlar material and a lower segment (58) formed of a nylon material. Line 46 may stretch easily for a length of 400 feet, a preferred submerged depth of the module (16). Module (16) includes a constant buoyant material (36) and a source of compressed gas (32) controlled by a remotely actuated valve (40) to provide a variable buoyancy.

11 Claims, 1 Drawing Sheet

FIG. 1
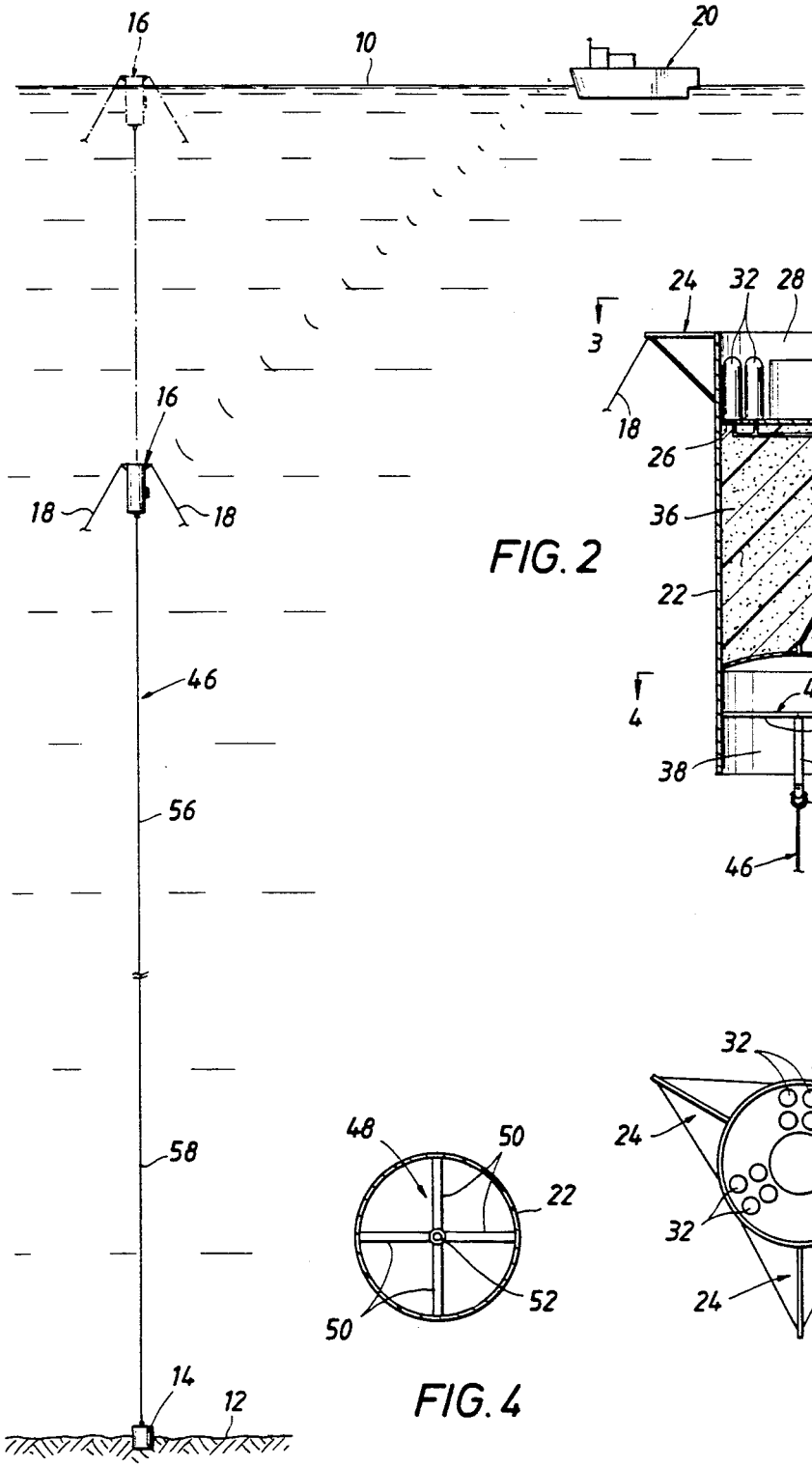
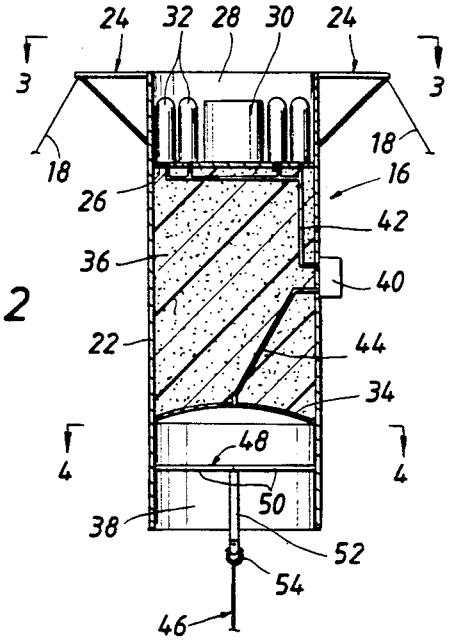
FIG. 2
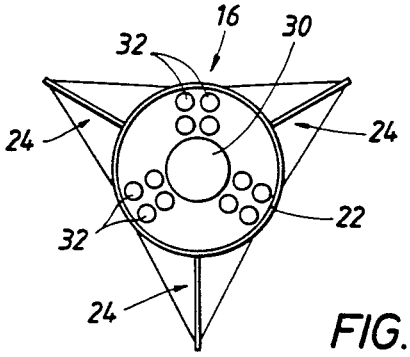
FIG. 3
FIG. 4

CONTROLLABLE VARIABLE DEPTH MOORING SYSTEM AND METHOD

FIELD OF THE INVENTION

This invention relates to a mooring system and method of anchoring a buoyant module in a submerged location in the sea.

BACKGROUND OF THE INVENTION

Heretofore, various types of mooring sytems have been utilized for mooring vessels and buoys floating on the surface of the sea. Weights or other anchors on the seabed or sea floor have commonly been used to secure the lower end of various lines or cables running to a buoy or vessel.

Additionally, so-called semi-submersible drilling vessels or drill ships have been provided heretofore for drilling in deep seas or oceans. Such drill ships have been moored over a well and are normally anchored to the seabed. In determining the design of a mooring system, wind, wave and current forces must be analyzed. The calculation of wind and current forces on a vessel are normally easily calculated. However, wave forces are more dificult to evaluate as waves tend to load the mooring lines and fluctuations in tension as may result from storms may be substantial.

A mooring system acts as a spring to resist offsetting of a vessel or other structure being moored or anchored. As in a spring, the restoring force increases with an increasing offset. The rate at which this force increases is conventionally referred to as the hardness or stiffness of a mooring sytem. A restoring force calculation is normally made by using the catenary equation which describes a line that is suspended at its two ends and allowed to sag under its own weight. The hardness of a mooring system decreases with water depth. Mooring lines have normally included chains, cables, and wire ropes of various designs and sizes.

Submerged acoustic arrays for subsea listening purposes have existed for many years. Such arrays must periodically be brought to the sea surface for maintenance. Before the invention described below, it has been a costly time consuming procedure to bring such arrays to the surface and to redeploy them safely at a submerged position.

Buoyant modules have been used in subsea operations for attachment to risers in the offshore drilling art between the sea floor and the surface to decrease the tension required at the surface. These modules have included thin-walled air cans or fabricated syntactic foam modules that are strapped to the riser. Air cans have a predictable buoyancy and the buoyancy can be controlled from the surface by displacing water from the cans by air pressure. Syntactic foam modules have been used with various compositions of foam.

SUMMARY OF THE INVENTION

The present invention is directed particularly to a mooring system and method of anchoring a buoyant module. One preferred application of the invention is to support a plurality of acoustical lines or arrays in a submerged location in the sea at depths of around 400 feet for example.

The buoyant support device or module has a constant buoyant member to provide a constant buoyancy to the module, and variable buoyancy means to provide upon command a variable buoyancy to the module to effect a predetermined movement of the submerged module to seal level for servicing. A preferred variable buoyancy means includes a source of compressed gas on the module for release upon command from a remote location to effect raising of the module to the surface of the sea. During such movement of the module from a submerged location to a surface location, the stretchable leg is tensioned and assists, upon relieving of the tension, subsequent return movement of the module to the submerged location from the surface location after the servicing operation is completed.

The buoyant module is secured to the seabed by a weighted device or member on the seabed such as a reinforced concrete structure. A single anchor leg or line is secured between and extends in a generally vertical direction from the bottom of the buoyant module to the weighted member on the sea floor. The anchor leg is of a variable length to permit raising of the submerged buoyant module to the surface of the sea for servicing. A preferred variable length leg includes a stretchable elastic leg.

In the preferred embodiment for supporting acoustical arrays, the acoustical arrays include a plurality of sound devices therein for receiving subsea or surface sounds (for example from submarines or surface ships) and comprise a taut line or cable extending from the submerged support module to the seabed. While the submerged support or control module may be at lesser depths in the sea such as 200 feet, if may be desired that the entire system be at a depth of around 400 feet for operational reasons or to minimize forces from wave and wind actions. The primary design force at a depth of 400 feet comprises current because forces from wave and wind actions are relatively minor.

An active acoustical array secured to a submerged buoyant module may have a service life of around two years, for example, and must be raised from the sea for servicing, and then subsequently lowered to its operational depth. The submerged buoyant module may be secured to the sea floor by a taut line separated into three segments: (1) an upper segment formed of a lightweight and strong material such as Kevlar (a DuPont trademark) material attached to the buoyant module and containing the acoustical devices, (2) an intermediate segment formed of a polyester material, and (3) a lower chair anchored to the seabed.

The invention may be used to support other devices in the sea other than the acoustical arrays described above. It may be used in other applications because of its capability to be raised and lowered without heavy mechanical winches. For example, the mooring system of the invention may be used to support an electronic data gathering device while submerged and to raise it to the surface for transmitting stored dated to a receiving antenna on a ship, airplane or satellite and to return such device to its submerged location.

The invention may find use in the marine mooring industry. For example, in certain disconnectable turret mooring systems, a floating production storage and offloading vessel is moored by means of a transfer structure having a portion that may be detached from the rest of the structure on the vessel. Such detached structure must submerge to a certain depth so as to allow the vessel to be removed from the site during storms, ice flows, etc. Accordingly, this invention may be used to support the detached structure in a submerged position while the vessel is removed and may be used to raise it to the surface for connection to other portions of the transfer structure when the vessel returns to the location.

Identification Of Objects Of The Invention

It is an object of this invention to provide a mooring system and method for mooring a buoyant module in a submerged location in the sea.

An additional object of this invention is to provide such a submerged module for supporting a plurality of acoustical arrays extending between the module and the seabed or sea floor.

A further object of this invention is to provide a buoyant module for use in such a mooring system and method which is anchored to the seabed from an anchor leg of varying length to permit movement of the module between a submerged location for operation and a surface location for servicing.

A still further object is to provide such a buoyant module which includes a constant buoyancy member and a variable buoyancy member.

An additional object of the invention is to provide a method of securing a plurality of acoustical arrays in a submerged location of a sea for receiving and transmitting sound signals.

Other objects, features, and advantages of this invention will become more apparent after referring to the following specification and drawings.

BRIEF DESCRIPTION OF THE DRAWINGS

FIG. 1 is a schematic view of the mooring system of the present invention illustrating the buoyant module anchored by a single leg in a submerged location for operation and particularly illustrating a preferred embodiment of the system for supporting a plurality of acoustical arrays;

FIG. 2 is an enlarged sectional view of the buoyant module shown in FIG. 1 showing a foam material to provide a constant buoyancy and a compressed gas source for providing variable buoyance;

FIG. 3 is a top plan view looking generally along line 3—3 of FIG. 2; and

FIG. 4 is a section taken generally along line 4—4 of FIG. 2.

DESCRIPTION OF THE INVENTION

Referring now particularly to FIG. 1, a mooring system illustrating the present invention is shown schematically. The sea level or the surface of the sea is designated at 10 and the seabed or sea floor is designated at 12. A weighted member, such as a reinforced concrete block, is shown at 14 on sea floor 12. A buoyant module forming an important part of this invention is shown generally at 16. Illustrating a preferred embodiment of the invention, a plurality of acoustical arrays each indicated partially at 18 are connected to and extend outwardly from module 16. As indicated above, other emdodiments of the invention include supporting an electronic data gathering device transmitter and antenna as one example and for supporting a portion of a transfer structure for a disconnectable mooring system as another example.

In the preferred embodiment as illustrated in FIGS. 1 and 2, three acoustical arrays 18 are spaced from each other at 120 degree intervals about module 16. Each acoustical array or line 18 comprises a taut line extending outwardly from module 16 and anchored to sea floor 12 by a suitable weight or other anchoring means (not shown). Each acoustical array or line 18 preferably includes three separate segments integrally attached to each other including (1) an upper segment formed of a lightweight and strong material such as Kevlar (a DuPont trademark) material including suitable electronic acoustical devices for transmitting and receiving acoustical signals, (2) an intermediate polyester segment, and (3) a lower segment formed of a chain for anchoring to the weight. As an example, for a water depth of 16,404 feet (5,000 meters) the upper segment for acoustical array 18 comprises a length of 10,000 feet, the intermediate segment comprises a length of 11,000 feet, and the lower chain segment comprises a length of 270 feet.

Acoustical signals are received in electronic devices in acoustical arrays 18. Such signals are stored and/or transmitted to remote receivers (not shown). It is desirable that acoustical arrays 18 be located at a substantial depth below surface 10 of the sea in order to maximize survivability of the mooring system and to minimize forces from wave or wind actions. While module 16 may be positioned at a submerged location around 100 feet below sea level 10, a preferred submerged depth for module 16 is around 400 feet, because wave and wind actions are minimal at such depth. The service life of an acoustical array is around two years or more, and arrays 18 must be made accessible for servicing. For that purpose, it is necessary that module 16 along with acoustical arrays 18 be lifted or raised to surface 10 as shown in the broken line indication of module 16 on FIG. 1.

As illustrated in FIG. 2, buoyant module 16 comprises a generally cylindrical body 22 having three brackets 24 extending outwardly therefrom for anchoring the upper ends of acoustical arrays 18. An upper plate 26 in cylindrical body 22 forms an open ended upper chamber 28. Plate 26 supports a centrally positioned equipment storage compartment shown at 30 and a plurality of gas cylinders 32 which preferably contain compressed nitrogen gas. Gas cylinders 32 contain a source of compressed gas for providing a variable buoyancy to module 16 and to provide a displacement of water when the compressed gas is released for movement of module 16 from a submerged position or location to a position on sea surface 10 for servicing.

A hemispherical bottom panel or plate 34 in cylindrical body 22 forms on one side an intermediate chamber with plate 26 in which preferably a syntactic foam material 36 is provided to provide a constant buoyancy to module 16. Instead of using foam material 36 for fixed buoyancy, such fixed buoyancy may be provided by forming air tight compartments within module 16 with steel construction.

Variable buoyancy for the system is preferably provided by an open ended bottom chamber 38 on the other side of plate 34 for trapping gas from cylinders 32 for the displacement of water in chamber 38 to raise or lift module 16 from submerged location. The release of compressed gas from cylinders 32 is controlled from a remote location by a suitable valve 40 actuated by acoustical signals from the remote location, such as vessel 20, for example. A fluid line 42 extends from cylinders 32 to valve 40 and fluid line 44 extends from valve 40 to lower chamber 38. Valve 40 is movable between three positions; (1) a closed position in which lines 42 and 44 are blocked, (2) an open position in which lines 42 and 44 are placed in fluid communication, and (3) a vent position in which line 44 and chamber 38 are vented to the outside. Variable buoyancy may also be provided in other ways than the preferred compressed gas. Chemical agents which react on mixing or exposure to sea water could also be used to produce the gas necessary to achieve variable buoyancy.

For anchoring module 16 at a submerged location, a single variable length anchor line or leg is shown generally at 46 extending in a generally vertical direction between module 16 and weight or anchor 14 on sea floor 12. A spider type support generally indicated at 48 is shown in FIG. 4 and has two generally horizontal support members 50 secured at their outer ends to the inner surface of cylindrical body 22. A vertical support member 52 supported by members 50 extends vertically downwardly from spider support 48 and has a clevis type connection 54 at its lower end for anchoring the upper end of anchor line 46.

Anchor line 46 is formed of a stretchable material providing a variable length to permit movement of module 16 from a submerged location to a surface location as indicated in broken lines in FIG. 1. As a specific but non-limiting example of anchor line 46 with module 16 at a submerged location of 400 feet and a total water depth of 16,404 feet (5,000 meters), line 46 includes an upper segment 56 made of a Kevlar (a DuPont trademark) material of around two inches in diameter integrally connected to a lower segment 58 made of a nylon material of around three inches in diameter Upper segment 56 initially is 3,987 feet in length and lower segment 58 initially is 10,871 feet in length. Upper segment 56 is initially stretched 13 feet while lower nylon segment 58 is initially stretched 1,129 feet at the submerged position. After movement to the surface position, upper segment 56 is stretched an additional 7 feet while lower segment 58 is stretched an additional 392 feet.

Although Kevlar is the preferred material for upper segment 56, other strong materials may be used in a particular application. Materials, and lengths of upper segment 56 and lower segment 58 may be selected according to the water depth, depth at submergence and maximum loads on the anchor by 46.

A preferred design for the invention calls for mounting of three acoustical arrays 18 at a submerged depth of 400 feet below the sea surface 10 and for a total sea depth of 16,404 feet. Table 1 indicates the neutral lengths and initial stretch lengths for the Kevlar section 46 and nylon segment 58. Such initial stretch is that obtained at the submerged location. Delta stretch is the additional stretch obtained in segments 56 and 58 when module 16 is moved from the submerged position to a surface position or location.

TABLE 1

SINGLE ANCHOR LEG PREFERRED DESIGN

| KEVLAR NEUTRAL LENGTH (FEET) | KEVLAR INITIAL STRETCH (FEET) | KEVLAR AT DEPTH LENGTH (FEET) | KEVLAR DELTA STRETCH (FEET) | KEVLAR FINAL LENGTH (FEET) | NYLON NEUTRAL LENGTH (FEET) |
|---|---|---|---|---|---|
| 3,987 | 13 | 4,000 | 7 | 4,007 | 10,871 |
| NYLON INITIAL STRETCH (FEET) | NYLON AT DEPTH LENGTH (FEET) | NYLON DELTA STRETCH (FEET) | NYLON FINAL LENGTH (FEET) | DELTA LINE TENSION (KIPS) | FINAL LINE TENSION (KIPS) |
| 1,129 | 12,000 | 392 | 12,392 | 20 | 55 |

The preferred design calls for segment 56 to be a length of 4000 feet and the nylon segment 58 of a length of 12,000 feet at the submerged position of module 16. When module 16 moves to the surface position, upper segment 56 is stretched an additional 7 feet and lower segment 58 is stretched an additional 392 feet.

Sufficient gas is provided in cylinders 32 to allow for at least two cycles of submergence of module 16 and including a 35 percent excess. Cylinders 32 are packaged in groups of four for convenience of reloading from a small work boat. The variable buoyancy provided by discharge of gas from cylinders 32 into lower chamber 38 provides sufficient displacement force necessary to stretch anchor leg 46 for movement of module 16 to the surface location. No power source other than the compressed gas is required to raise or lower module 16. Any control signals are transmitted acoustically to valve 40.

Although a single anchor leg 46 between module 16 and sea floor 12 is illustrated in FIG. 1 and described above, the invention includes other anchor leg arrangements. For example, several anchor legs connected between module 16 and sea floor 12 may be desirable for certain applications. Such anchor legs may be connected between module 16 and three, four or more anchors.

Operation

For movement of module 16 from the submerged position to the surface position, a command signal is provided acoustically from a remote location (for example, boat 20) to valve 40 to move valve 40 to a position in which lines 42 and 44 are in fluid communication to permit the release of compressed gas through lines 42 and 44 to lower chamber 38 thereby to displace the sea water in chamber 38 and effect upward movement of module 16 to a surface location. After the servicing operation has been completed and it is desired to return module 16 to submerged position, valve 40 is actuated to vent line 44 and lower chamber 38 for removal of any air from chamber 38. In this position, buoyant module 16 will lower to the operational depth of 400 feet as the tension in anchor line 46 is relieved.

Weight 14 has been designed to be of around 120 kips and preferably comprises a reinforced concrete base which is lowered by gravity onto the sea floor 12. A suitable work vessel or the like at the surface may be provided for the lowering of weight 14. The mooring system at a depth of 400 feet is designed primarily to resist current forces as wind and wave forces at a 400 foot depth are not substantial. The use of a single variable length anchor leg acting as a spring provides an anchor for a submerged module which may be easily raised and lowered for many cycles to provide servicing. Various types of variable length anchor legs may be provided and a stretchable member is illustrated as being a preferred embodiment. Thus, servicing may be effected without any disconnecting of any securing or anchoring members. All that is required for operation is the acoustical actuation of a valve to release a compressed gas source or to vent a lower chamber in the module.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is :

1. A mooring system for anchoring a buoyant support device in a predetermined submerged location in the sea spaced above the seabed and at least around 100 feet below sea level for effecting movement of the support device from the predetermined submerged location to a sea level surface location for access; said mooring system comprising:

anchoring means including a weighted member on the seabed and at least one anchoring leg of a variable length extending between said weighted member and said buoyant support device, said one anchoring leg comprising a stretchable member for being stretched between said submerged location and said surface location when said support device moves therebetween;

said buoyant support device including constant buoyancy means comprising a buoyant foam material for providing constant buoyancy to said support device, and variable buoyancy means comprising compressed gas released upon command for providing variable buoyancy to said buoyant support device when submerged to effect a predetermined movement of said support device to sea level.

2. A mooring system as set forth in claim 1 wherein a plurality of acoustical arrays are supported on said buoyancy support device and extend therefrom a substantial distance submerged in the sea.

3. A single leg mooring and buoy system for supporting a plurality of acoustical arrays in a desired pattern at a predetermined submerged depth in the sea spaced above the seabed comprising:

a weighted anchor on the seabed;

a buoyant module supporting the plurality of acoustical arrays at a predetermined submerged location in the sea above the seabed:

an elastic anchor leg extending between said buoyant module and said weighted anchor for anchoring said buoyant module during normal operation at said predetermined submerged depth, and remote controlled means on said buoyant module to raise said module upon command from said submerged location to a surface location on said sea for servicing with said elastic anchor leg being stretched between said submerged location and said surface location:

said buoyant module including a buoyant material to provide a constant buoyancy and a compressed gas source to provide variable buoyancy to effect movement of said module from said predetermined submerged location to said surface loation while resisted by said elastic anchor leg.

4. A single leg mooring and buoy system as set forth in claim 3 wherein said leg includes a nylon material.

5. A single leg mooring and buoy system as set forth in claim 3 wherein said compressed gas source comprises a plurality of compressed gas cylinders and said remote controlled means controls the release of gas from said gas cylinders.

6. A method for anchoring a buoyant module in a predetermined submerged location in the sea above the seabed for normal operation and for raising the buoyant module to a surface location on the sea comprising the steps of :

providing a buoyant module having a body, with means for providing constant buoyancy to said body and means for accepting gas from a gas source to provide a variable buoyancy;

providing a variable length anchor member which increases in length upon the application of a predetermined tensioning force;

connecting one end of the variable length anchor member to the buoyant module and connecting the other end of a fixed location on the seabed to position the buoyant module at a submerged location at least 100 feet below the surface of the sea;

releasing compressed gas from said compressed gas source to effect movement of said buoyant module from said submerged location to said surface location: and returning said module from the surface location after servicing upon actuation of said variable buoyancy means by command from a remote location for venting of said module to effect submerging of said module to a predetermined submerged depth in the sea.

7. A method of anchoring a buoyant module as set forth in claim 6 further including the steps of providing a stretchable member for said variable length anchor member; and connecting the stretchable member between the buoyant module and the seabed for anchoring the module in the submerged location.

8. The method of anchoring a buoyant module as set forth in claim 6 further including the step of mounting a plurality of elongate acoustical arrays on said module for extending into the sea from the module to receive acoustical signals from the sea to transmission from the module to a remote location.

9. A method of securing a plurality of acoustical arrays in a predetermined submerged location of a sea spaced above the seabed for receiving and transmitting sound signals comprising the steps of :

providing a buoyant module having a body, a buoyant material therein to provide a constant buoyancy, and a selectively variable buoyancy means;

mounting a plurality of elongate acoustical arrays on said module for extending into the sea from the module to receive acoustical signals from the sea;

providing a variable length anchor member which increases in length upon the application of a predetermined tensioning force;

connecting the variable length anchor member to the buoyant module and to a fixed location on the seabed to position the buoyant module at a submerged location at least 100 feet below the surface of the sea;

acutating upon command from a remote location said selectively variable buoyancy means to effect movement of said buoyant module and connected acoustical arrays from the submerged location to a surface location at sea level for servicing; and returning said module and acoustical arrays from the surface location to the predetermined submerged location upon command for actuation of said variable buoyancy means and venting of an air chamber open to the sea.

10. The method as set forth in claim 9 including the steps of:

providing a stretchable member for said variable length anchor member; and connecting the stretchable member between the buoyant module and the seabed for anchoring the module in the submerged location with said stretchable member being stretched upon movement from the submerged location to the surface location.

11. A single leg mooring and buoy system for supporting a plurality of acoustical arrays in a desired pattern at a predetermined submerged depth in the sea above a seabed and comprising:

a weighted anchor on the seabed;

a buoyant module supporting the plurality of acoustical arrays at a predetermined submerged location in the sea;

an elastic anchor leg extending between said buoyant module and said weighted anchor for anchoring said buoyant module during normal operation at said predetermined submerged depth, and remote controlled means on said buoyant module to raise said module upon command from said submerged location to a surface location on said sea for servicing with said elastic anchor leg being stretched between said submerged location and said surface location;

said buoyant module comprising a generally cylindrical body having a buoyant foam material therein to provide a constant buoyancy and a compressed gas source to provide variable buoyancy to effect movement of said module from said submerged location to said surface location while resisted by said elastic leg.

* * * * *